US009770814B2

(12) United States Patent
Huang

(10) Patent No.: US 9,770,814 B2
(45) **Date of Patent: *Sep. 26, 2017**

(54) MONKEY WRENCH

(71) Applicant: Yu-Shiang Huang, Taichung (TW)

(72) Inventor: Yu-Shiang Huang, Taichung (TW)

( * ) Notice: Subject to any disclaimer, the term of this patent is extended or adjusted under 35 U.S.C. 154(b) by 300 days.

This patent is subject to a terminal disclaimer.

(21) Appl. No.: 14/669,012

(22) Filed: Mar. 26, 2015

(65) Prior Publication Data

US 2016/0151893 A1 Jun. 2, 2016

(30) Foreign Application Priority Data

Nov. 27, 2014 (TW) ..... 103141129 A

(51) Int. Cl.
*B25B 13/50* (2006.01)
*B25B 23/00* (2006.01)
*B25B 13/22* (2006.01)

(52) U.S. Cl.
CPC ..... *B25B 23/0007* (2013.01); *B25B 13/22* (2013.01)

(58) Field of Classification Search
None
See application file for complete search history.

(56) References Cited

U.S. PATENT DOCUMENTS 5,832,793 A * 11/1998 Collins ..... B25B 13/5058 81/138
6,026,716 A * 2/2000 Orlosky ..... B25B 13/5058 81/322

* cited by examiner

*Primary Examiner* — Joseph J Hail
*Assistant Examiner* — Brian Keller

(57) ABSTRACT

A monkey wrench includes a body, a first jaw, a second jaw and a press member. The second jaw is linearly movable relative to the body. The first and second jaws each have an operation member which has second teeth defied in on side thereof. The second jaw has first teeth on the top thereof and the press member has third teeth. When pivoting the press member to engage the third teeth with the first teeth, the second jaw is secured. A resilient member is connected to the second jaw which is movable when the press member is pivoted in the opposite direction to disengage the third teeth from the first teeth.

8 Claims, 8 Drawing Sheets

MONKEY WRENCH

BACKGROUND OF THE INVENTION

1. Fields of the Invention

The present invention relates to a monkey wrench, and more particularly, to a monkey wrench wherein the movement of the movable jaw is controlled by a press member.

2. Descriptions of Related Art

The conventional monkey wrench, such as the monkey wrench disclosed in U.S. Pat. No. 1,027,203, generally comprises an L-shaped body, a movable member with a U-shaped cross section, a press member, an engaging member and a resilient member. The body has a first jaw connected thereto. The movable member is located at the range of the engaging member, and has a recess which has two open ends. A reception hole and a notch are respectively defined in the recess. The press member has a U-shaped connection portion and a press portion which is located in the notch. The connection portion has a first pivotal portion. The engaging member is located in the reception hole and pivotably connected to the first pivotal portion. The engaging member is engaged with the engaging portion. The resilient member biases the engaging member onto the engaging portion. However, the engaging portion is longer than the movable member and exposed outside of the body. When pressing the press portion, the engaging member is disengaged from the engaging portion, so that the movable member is freely movable relative to the body. This may make the movable member, the press member, the engaging member and the resilient member to be shifted and removed from their positions. The connection portion and the press portion of the press member are difficult to be machined. Furthermore, the reception hole and the notch in the recess are different machined.

The present invention intends to provide a monkey wrench to eliminate the shortcomings mentioned above.

SUMMARY OF THE INVENTION

The present invention relates to a monkey wrench and comprises a body, a first jaw, a second jaw and a press member. The second jaw is linearly movable relative to the body. The first and second jaws each have an operation member which has second teeth defied in on side thereof. The second jaw has first teeth on the top thereof and the press member has third teeth. When pivoting the press member to engage the third teeth with the first teeth, the second jaw is secured. A resilient member is connected to the second jaw which is movable when the press member is pivoted in the opposite direction to disengage the third teeth from the first teeth.

The primary object of the present invention is to provide a monkey wrench wherein the second jaw is secured or moveable by pivoting a press member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
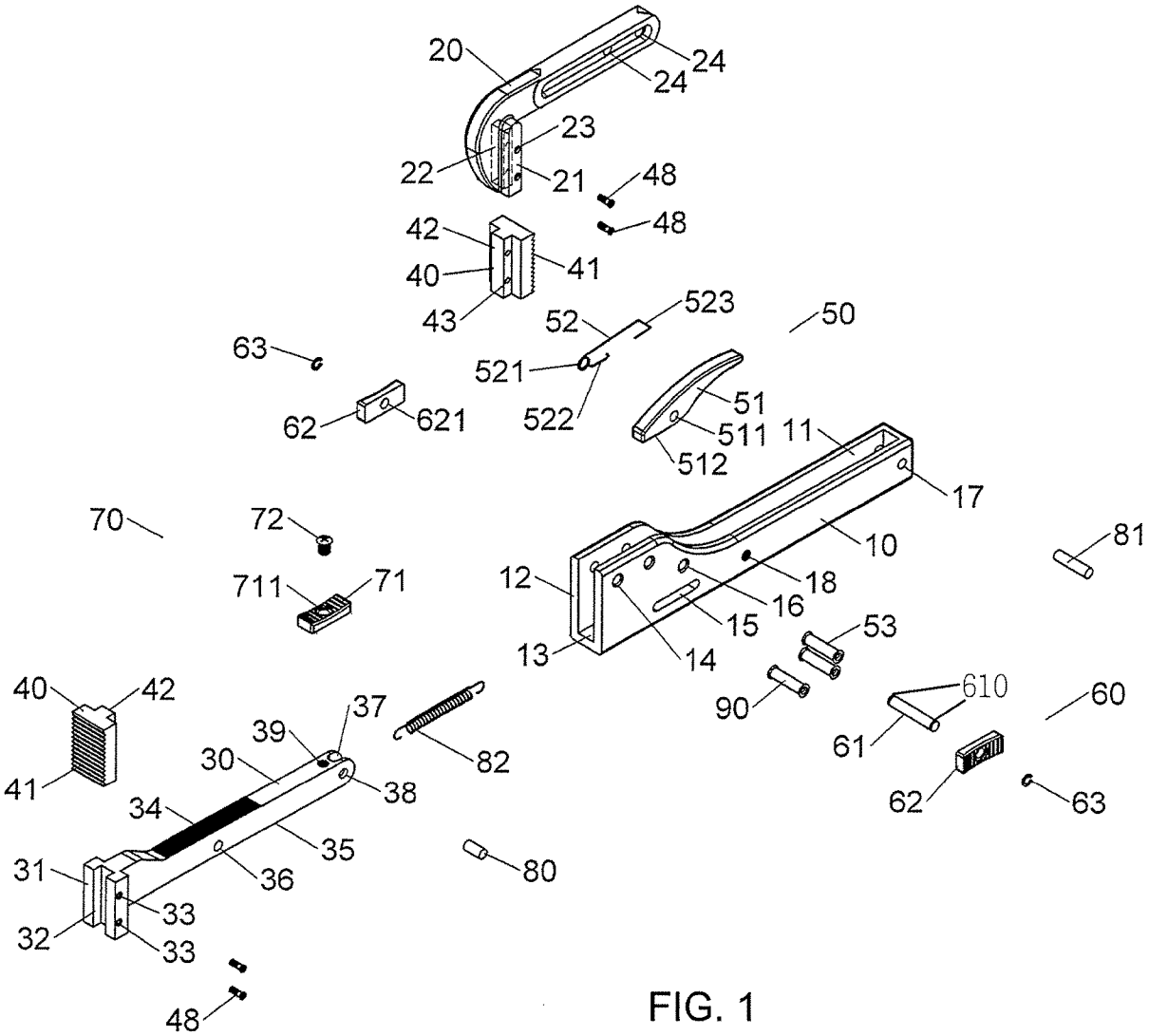
FIG. 1 is an exploded view of the monkey wrench of the present invention.
Figure 2:
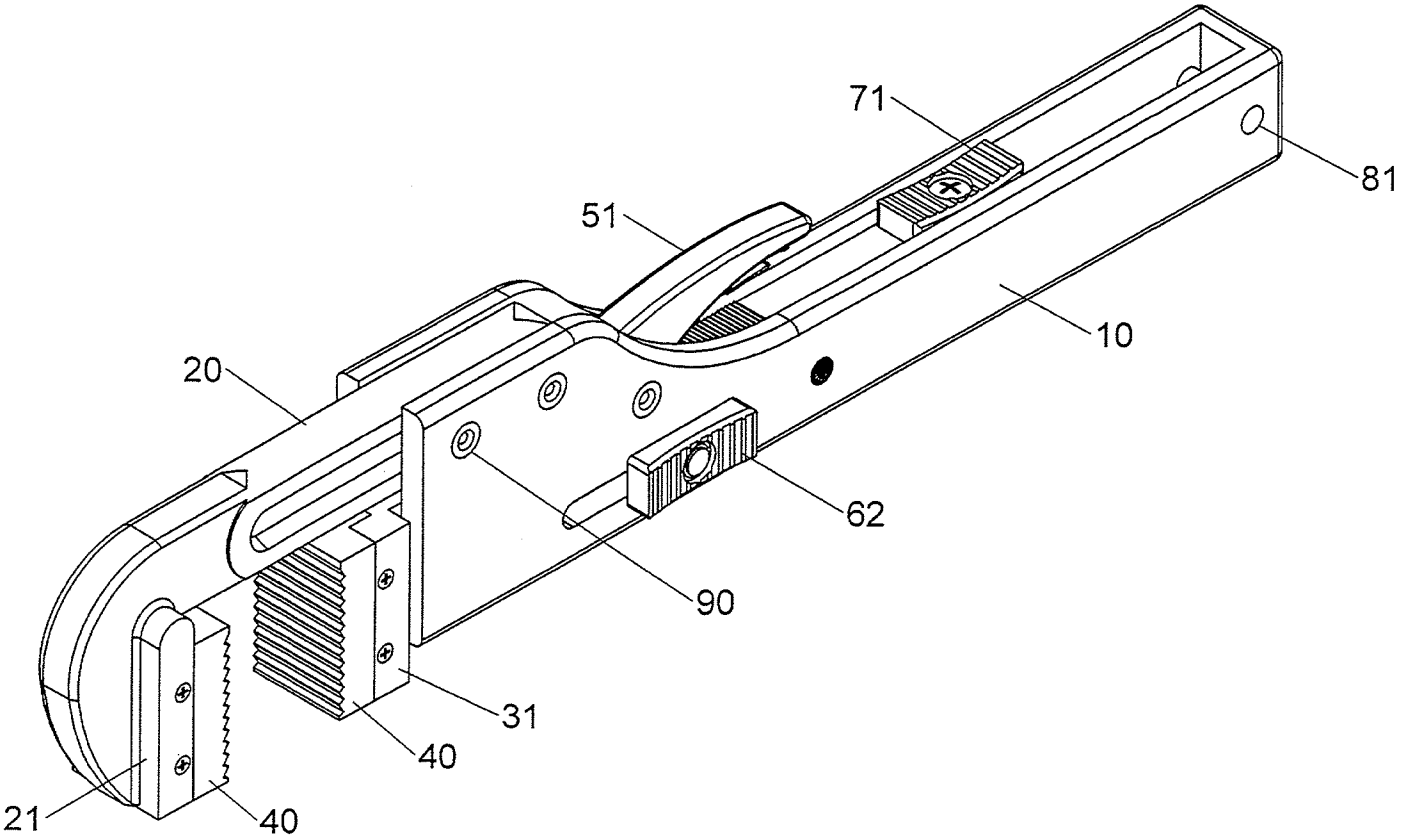
FIG. 2 is a perspective view to show the monkey wrench of the present invention.
Figure 3:
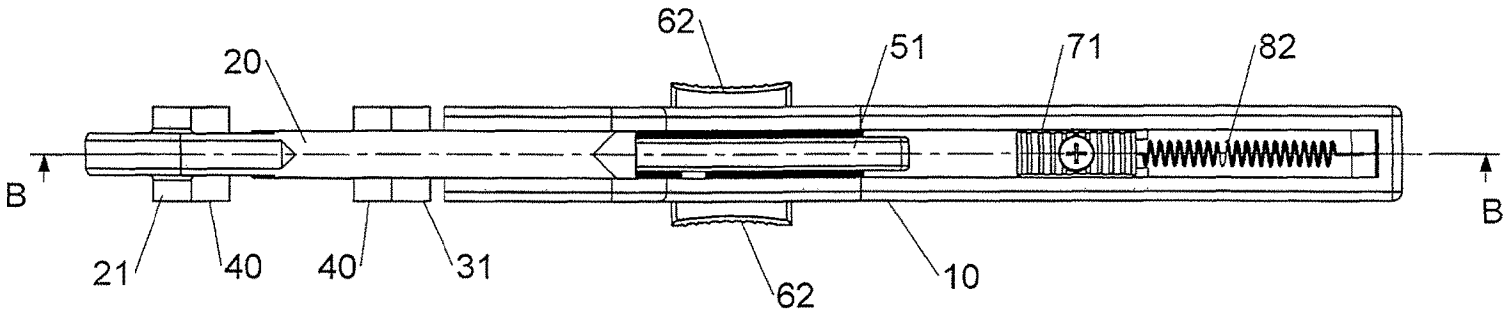
FIG. 3 is a top view to show the monkey wrench of the present invention.
Figure 4:
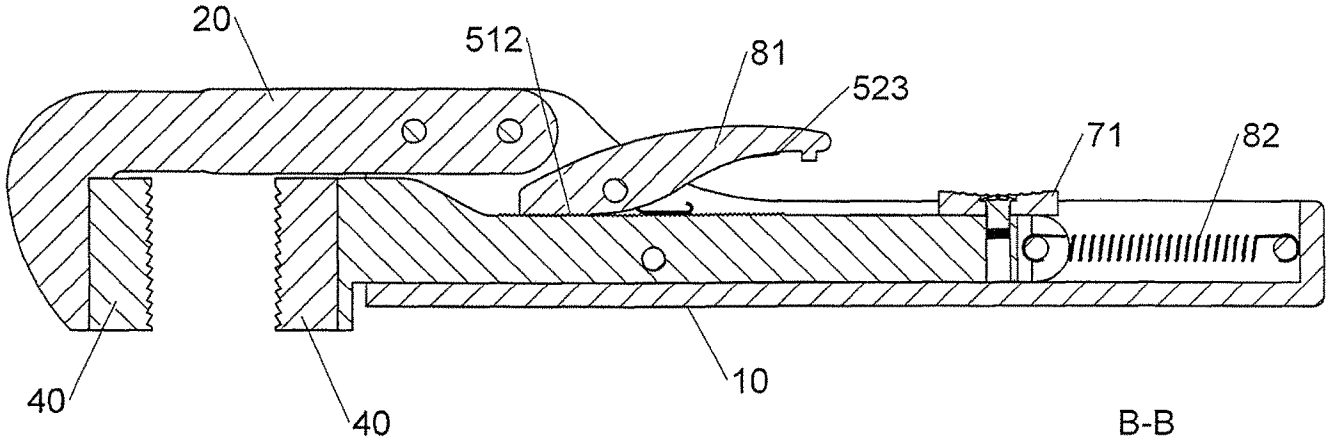
FIG. 4 is a cross sectional view, taken along line B-B in FIG. 3.
Figure 5:
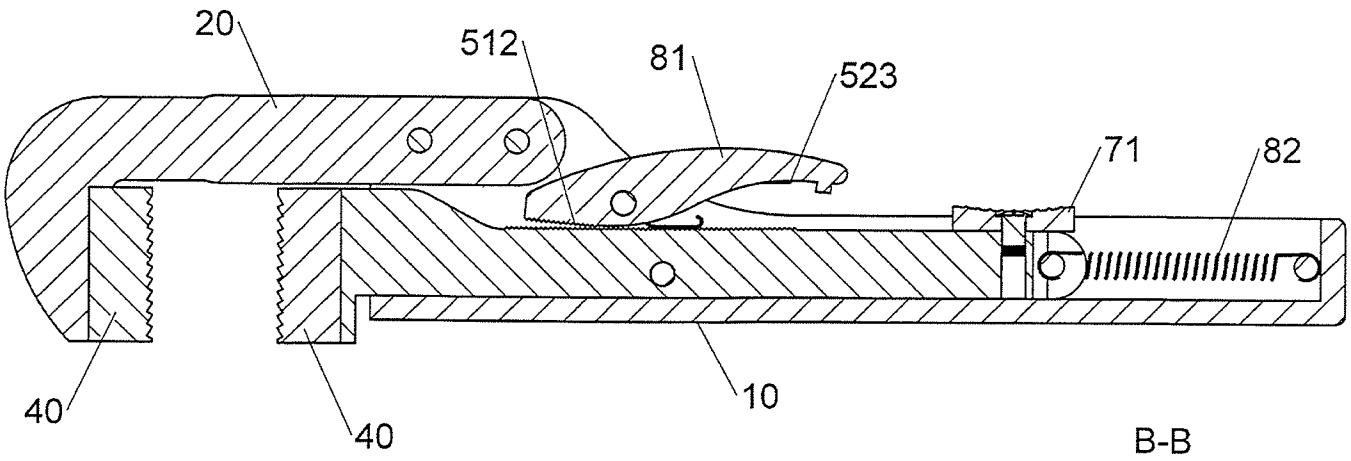
FIG. 5 is a side cross sectional view of the monkey wrench of the present invention.
Figure 6:
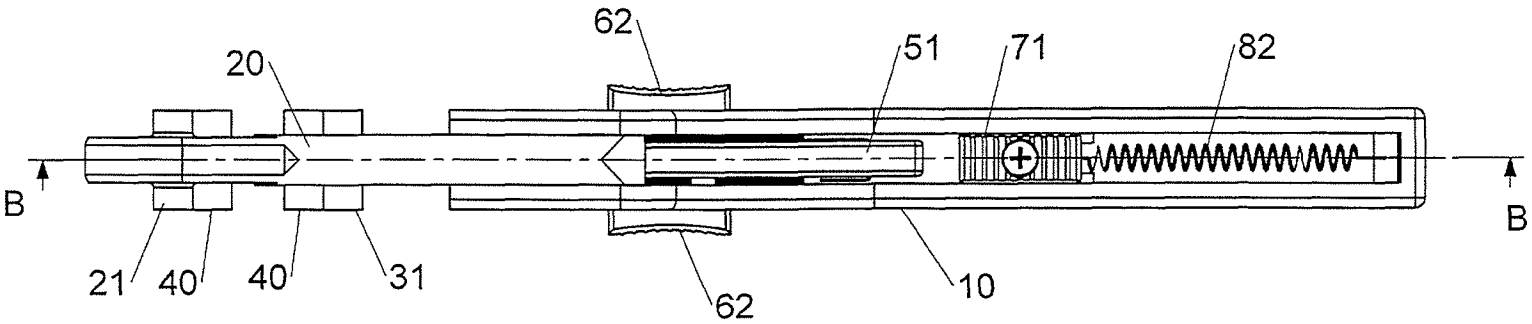
FIG. 6 is a top view to show that the adjustment of the second jaw of the monkey wrench of the present invention.
Figure 7:
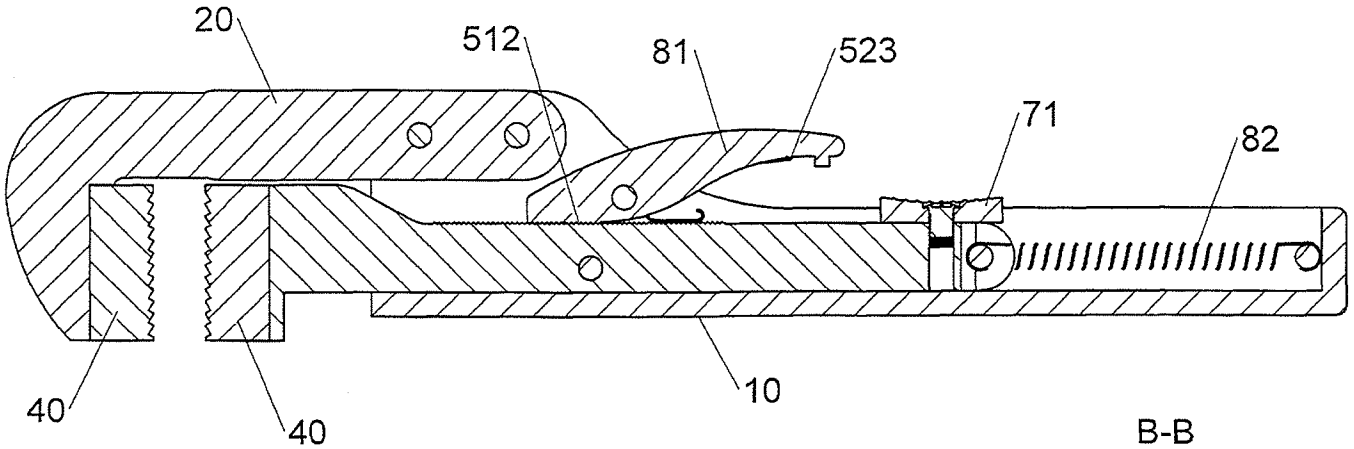
FIG. 7 is a cross sectional view, taken along line B-B in FIG. 6.

Referring to FIGS. 1 to 7, the monkey wrench of the present invention comprises a body 10, first jaw 20, a second jaw 30, two operation members 40, a press unit 50, a first control unit 60, a second control unit 70, a first rod 80 and a second rod 81.

The body 10 is an elongate body and has a U-shaped first recess 11 and a first pivotal portion 16, wherein the first recess 11 which is defined by two sidewalls of the body 10, and a first face 13 is connected between the two sidewalls. The body 10 has an open end 12 defined in the first end thereof, and a first circular hole 17 is defined through each of the sidewalls of the second end of the body 10. The body 10 has two first holes 14 which are located close to the open end 12. An elongate slot 15 is defined through each of the sidewalls and located higher than the first face 13. The first pivotal portion 16 is located above the elongate slots 15. The body 10 has a first threaded hole 18 defined in each of the two sidewalls thereof, and the threaded holes 18 are located at the middle portion of the body 10.

The first jaw 20 is an L-shaped jaw and partially located in the first recess 11. The first jaw 20 has a first connection portion 21 on one end thereof. The first connection portion 21 has a first slot 22, and multiple first connection holes 23 are defined through two sides defining the first slot 22. Each first connection hole 23 has inner threads and communicates with the first slot 22. The first jaw 20 has two second holes 24 in the other end thereof and the two second holes 24 are located corresponding to the first holes 14. The first jaw 20 is connected to the body 10 by extending a fixing member 90 through one of the two first holes 14 and one of the second holes 24.

The second jaw 30 is an elongate jaw, and a second connection portion 31 and a notch 37 are respectively formed on two ends of the second jaw 30. Multiple first teeth 34 are defined in the top of the second jaw 30. The second jaw 30 has a second face 35 defined in the underside thereof so as to be in contact with the first face 13. The second jaw 30 is received in the first recess 11 and slidable on the first face 13. The second connection portion 31 has a second slot 32, and multiple second connection holes 33 are defined through two sides defining the second slot 32. Each second connection hole 33 has inner threads and communicates with the second slot 32. The second jaw 30 has a third hole 36 defined transversely therethrough. A second threaded hole 39 is defined in the top of the second jaw 30. The third hole 36 is located corresponding to the elongate slots 15. The notch 37 has two extensions and each extension has a second circular hole 38. The distance between the second threaded hole 39 and the second connection portion 31 is longer than the distance between the second threaded hole 39 and the notch 37. The first jaw 20 is partially located above the second jaw 30 which is linearly movable along the first face 13. The second circular hole 38 and the second threaded hole 39 are located on different sides of the second jaw 30.

The two operation members 40 each have second teeth 41 defined in a face thereof. The two operation members 40 are respectively connected to the first connection portion 21 and the second connection portion 31. Each of the two operation members 40 is a T-shaped cross section and has a third connection portion 42 which is engaged with the first slot 22 or the second slot 32. The second teeth 41 of each operation member 40 are extend transversely. The two respective faces having the second teeth 41 of the operation members 40 face each other. The third connection portion 42 of each operation member 40 has third connection holes 43. Multiple first connection members 48 extend through the first connection holes 23 or the second connection holes 33 and are connected to the third connection holes 43 to connect the operation members 40 to the first connection portion 21 and the second connection portion 31. The first connection members 48 can be bolts.

The press unit 50 comprises a press member 51, a first resilient member 52 and a first rivet 53. The press member 51 has a second pivotal portion 511, and multiple third teeth 512 extend longitudinally on the press member 51. The first rivet 53 extends through the second pivotal portion 511 and the first pivotal portion 16. The press member 51 is pivotally connected to the body 10. The press member 51 is connected with the first resilient member 52 and pivotable about the first rivet 53. When the first resilient member 52 biases the press member 51 to engage the third teeth 512 with the first teeth 34, the second jaw 30 is secured in the first recess 11. The two operation members 40 are then able to clamp an object therebetween. In detail, the first resilient member 52 has a loop 521 which is located corresponding to the second pivotal portion 511. A first biasing portion 522 and a second biasing portion 523 are located on two ends of the first resilient member 52. The first biasing portion 522 biases the first teeth 34, and the second biasing portion 523 hooks to the press member 51 and biases the press member 51 so as to engage the third teeth 512 with the first teeth 34. The first rivet 53 extends through the first pivotal portion 16, the second pivotal portion 511 and the loop 521.

The first control unit 60 comprises a control rod 61, two first control members 62 and two clips 63. The control rod 61 extends through the elongate slots 15 and the third hole 36. The control rod 61 has a groove defined in each of two ends thereof, and the two ends of the control rod 61 are exposed out from the body 10. The first control members 62 are connected to two ends of the control rod 61. Each first control member 62 contacts the outside of one of the two sidewalls. The two control members 62 are located symmetrically relative to the body 10 and each are a rectangular member. Each of the control members 62 has a fourth hole 621 through which one of the two ends of the control rod 61 extends. The two clips 63 are engaged with the two grooves 610 of the two ends of the control rod 61 to connect the control members 62 to the control rod 61. The first control members 62 are pushed to drive the control rod 61 and the second jaw 30 to respectively move linearly along the elongate slot 15 and the first recess 11.

The second control unit 70 comprises a second control member 71 and a second connection member 72. The second control member 71 is connected to the second jaw 30 so that when the second control member 71 is moved, the second jaw 30 moves linearly in the first recess 11. The second control member 71 is fixed to the second jaw 30 and located close to the notch 37. The second control member 71 has a fifth hole 711 in the center thereof, and the fifth hole 711 located corresponding to the second threaded hole 39. The second connection member 72 extends through the fifth hole 711 and is threadedly connected to the second threaded hole 39. The second control member 71 is connected to the second jaw 30 by the second connection member 72.

The first rod 80 is snugly connected to the second circular holes 38 of the second jaw 30, and the second rod 81 is snugly connected to the first circular holes 17 of the body 10. A second resilient member 82 is located in the first recess 11 to resiliently connect the second jaw 30 to the body 10. The second resilient member 82 has a hook on each of two ends thereof, the two hooks are respectively connected to the first and second rods 80, 81.

The user can pivots the press member 51 to control the engagement between the third teeth 512 of the press member 51 and the first teeth 34 of the second jaw 30 to secure the second jaw 30 or to allow the second jaw 30 to linearly move along the first face 13 in the first recess 11.

When the third teeth 512 of the press member 51 are disengaged from the first teeth 34 of the second jaw 30, the user can also push one of the first control members 62 to respectively linearly move the control rod 61 and the second jaw 30 in the elongate slot 15 and the first recess 11. By pushing the second control member 71, the user can also move the second jaw 30 in the first recess 11.

Figure 8:
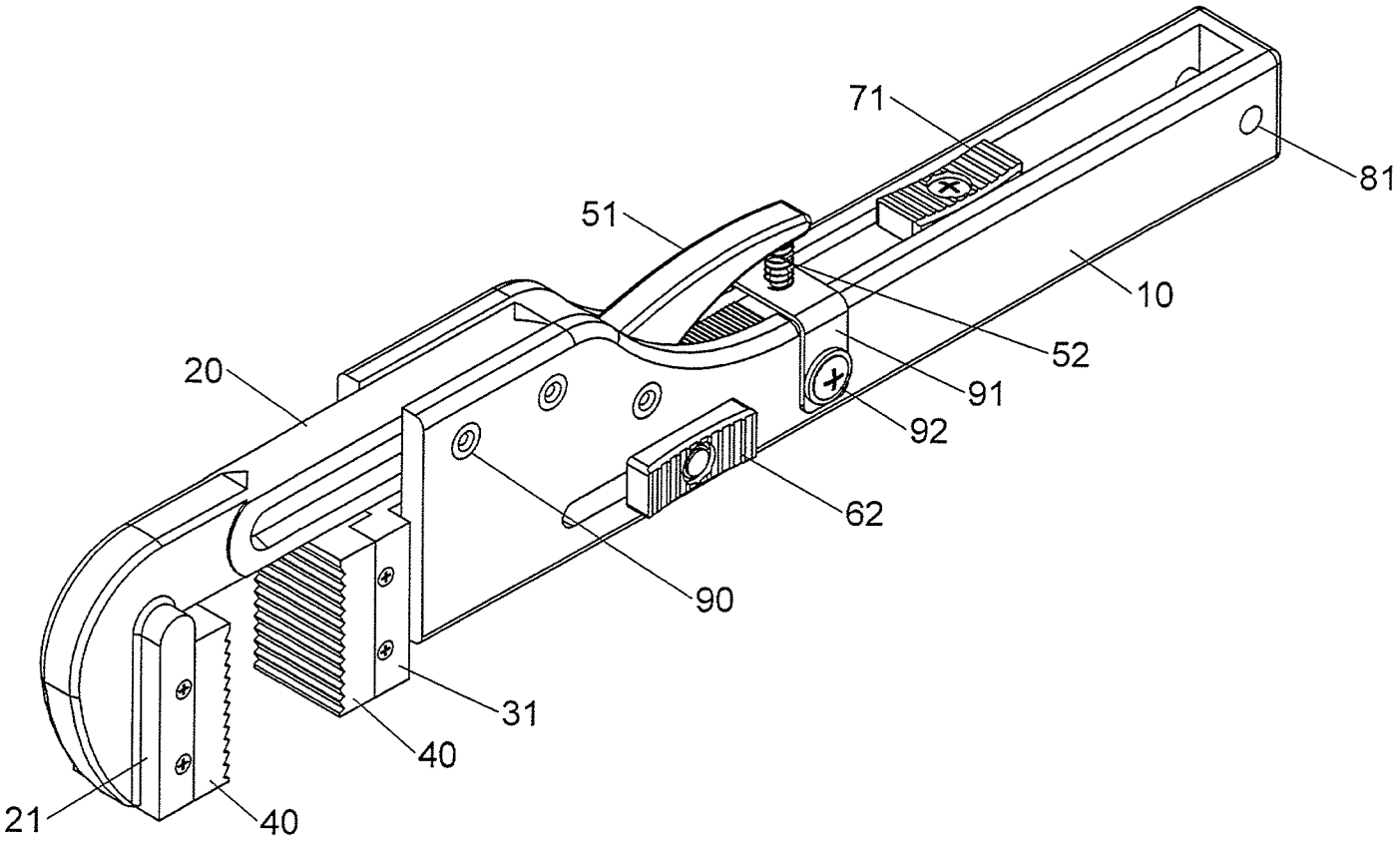
FIG. 8 is a perspective view to show the second embodiment of the monkey wrench of the present invention.

FIG. 8 shows that the second embodiment comprises a bracket 91 and two third connection members 92. The bracket 91 is a U-shaped member and mounted across the two sidewalls of the body 10. A first resilient member 52 is connected between the press member 51 and the bracket 91. The third connection member 92 extends through the bracket 91 and connected to the first threaded holes 18 (Referring to FIGS. 1 and 8).

Figure 9:
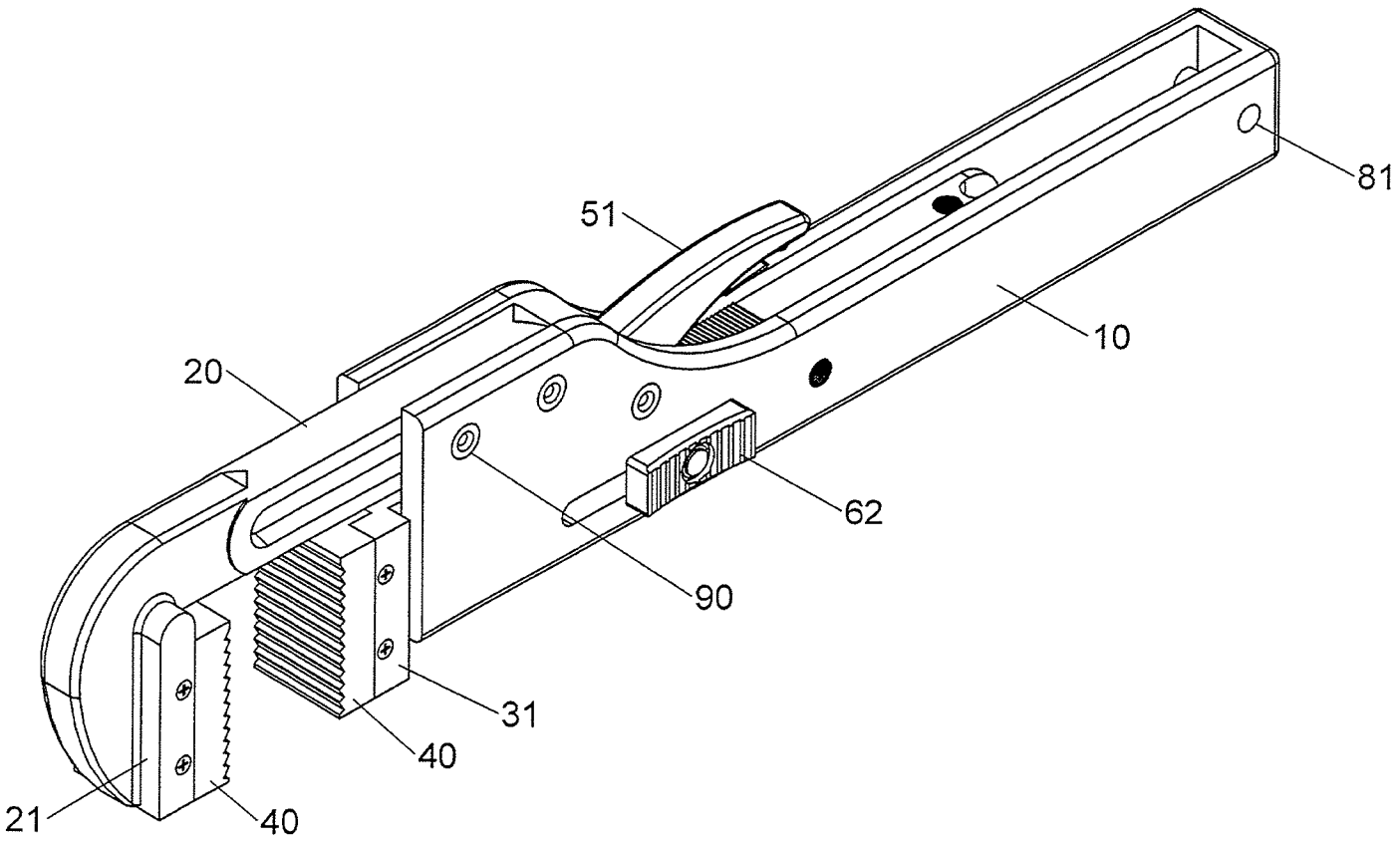
FIG. 9 is a perspective view to show the third embodiment of the monkey wrench of the present invention.

FIG. 9 shows the third embodiment of the present invention, wherein there is no second control unit 70 available.

Figure 10:
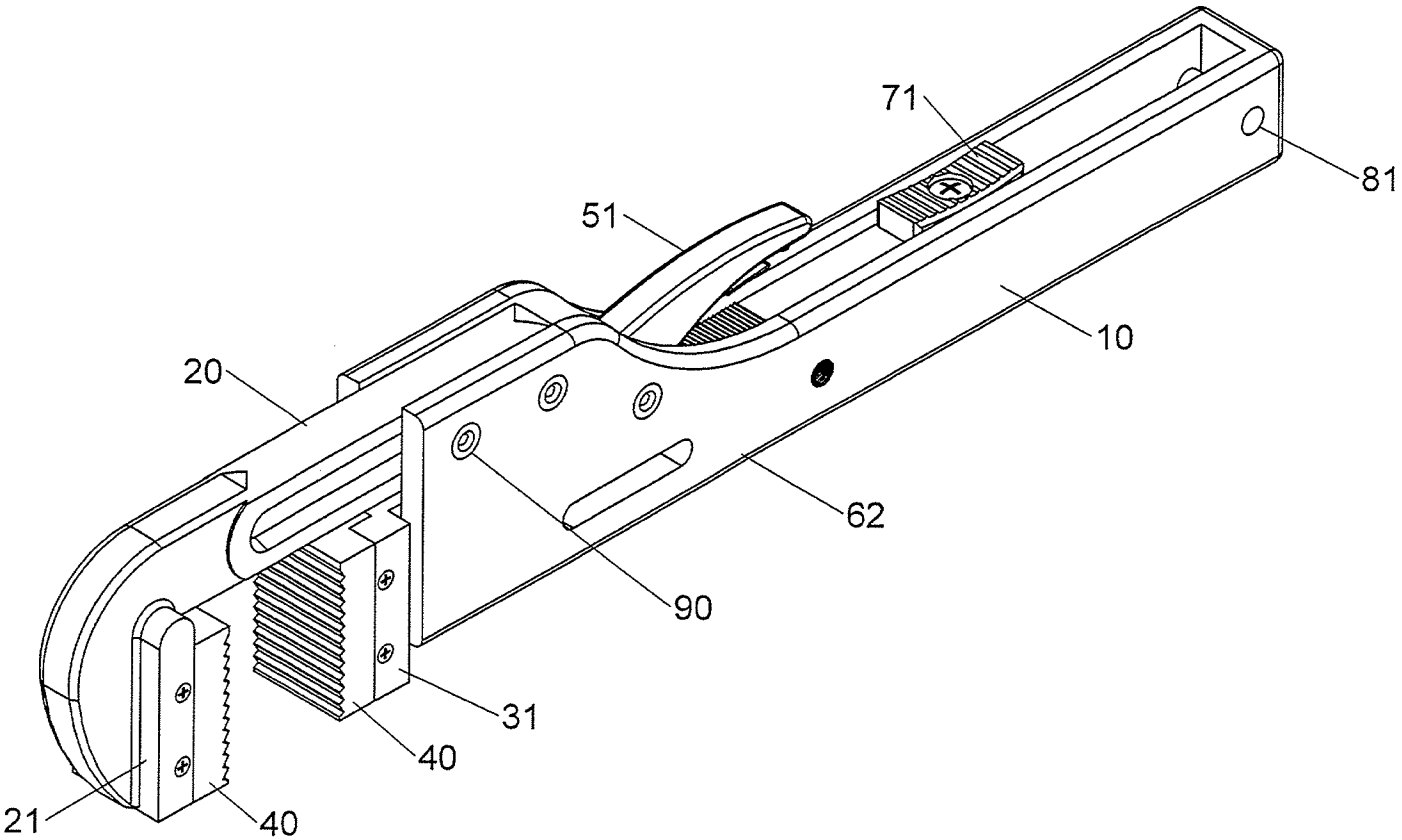
FIG. 10 is a perspective view to show the fourth embodiment of the monkey wrench of the present invention.

FIG. 10 shows the fourth embodiment of the present invention, wherein there is no first control unit 60 available.

It is noted that the first connection portion 21 can be integrally formed with the operation member 40, and the second connection portion 31 can be integrally formed with the operation member 40. Similarly, the first jaw 20 is integrally formed with the body 10. The fixing member 90 is connected to the first holes 14. The second jaw 30 located in the first recess 11 and is restricted by the fixing member 90. The first control member 62 can be integrally formed with the control rod 61. The first rod 80, the second rod 82 and the second resilient member 82 can also be omitted.

The first teeth 34 are hidden in the first recess 11 so that the user's fingers do not contact the first teeth 34. The press member 51 is pivotably connected to the first pivotal portion 16, the user can easily and comfortably operate the press member 51. The second jaw 30 can be secured when the third teeth 512 are engaged with the first teeth 34. When the third teeth 512 are disengaged from the first teeth 34, the second jaw 30 can be moved by either operating the first control member 62 or the second control member 71. There is one first control member 62 on each of the two sidewalls of the body 10 so that left-handed and right-handed user can easily use the present invention.

While we have shown and described the embodiment in accordance with the present invention, it should be clear to those skilled in the art that further embodiments may be made without departing from the scope of the present invention.

What is claimed is:

1. A monkey wrench comprising:

a body having a first recess and a first pivotal portion, the first recess being a U-shaped recess which includes two sidewalls of the body, a first face connected between the two sidewalls, the body having an open end defined in a first end thereof, a first circular hole defined through each of the sidewalls of a second end of the body, an elongate slot defined through each of the sidewalls and located higher than the first face, the first pivotal portion located above the elongate slots;

a first jaw being an L-shaped jaw and partially located in the first recess, the first jaw having a first connection portion on one end thereof;

a second jaw being an elongate jaw, a second connection portion and a notch respectively formed on two ends of the second jaw, multiple first teeth defined in a top of the second jaw, the second jaw having a second face defined in an underside thereof so as to be in contact with the first face, the second jaw received in the first recess and slidable on the first face, the second jaw having a third hole defined transversely therethrough, a second threaded hole defined in the top of the second jaw, the third hole being located corresponding to the elongate slots, the notch having two extensions and each extension having a second circular hole, a distance between the second threaded hole and the second connection portion being longer than a distance between the second threaded hole and the notch;

two operation members each having second teeth, the two operation members respectively connected to the first connection portion and the second connection portion;

a press unit having a press member, a first resilient member and a first rivet, the press member having a second pivotal portion and multiple third teeth extending longitudinally on the press member, the first rivet extending through the second pivotal portion and the first pivotal portion, the press member being pivotally connected to the body, the press member connected with the first resilient member and pivotable about the first rivet, when the first resilient member biases the press member to engage the third teeth with the first teeth, the second jaw is secured in the first recess;

a first control unit having a control rod and at least one first control member, the control rod extending through the elongate slots and the third hole, the at least one first control member connected to the control rod and contacting outside of one of the two sidewalls, the at least one first control member being pushed to drive the control rod and the second jaw to respectively move linearly along the elongate slot and the first recess;

a second control unit having a second control member and a second connection member, the second control member connected to the second jaw so that when the second control member is moved, the second jaw moves linearly in the first recess, the second control member fixed to the second jaw and located close to the notch, the second control member having a fifth hole in the center thereof, the fifth hole located corresponding to the second threaded hole, the second connection member extending through the fifth hole and being threadedly connected to the second threaded hole, the second control member connected to the second jaw by the second connection member;

a first rod connected to the second circular holes;

a second rod connected to the first circular holes, and a second resilient member located in the first recess to resiliently connect the second jaw to the body, the second resilient member having a hook on each of two ends thereof, the two hooks respectively connected to the first and second rods.

2. The monkey wrench as claimed in claim 1, wherein the body is an elongate body and has two first holes, the first jaw has two second holes, the first holes are located close to the open end, the body is connected to the first jaw by extending a fixing member through one of the two first holes and one of the second holes.

3. The monkey wrench as claimed in claim 1, wherein the first connection portion has a first slot, multiple first connection holes are defined through two sides defining the first slot, each first connection hole has inner threads and communicates with the first slot, the second connection portion has a second slot, multiple second connection holes are defined through two sides defining the second slot, each second connection hole has inner threads and communicates with the second slot, each of the two operation members includes a T-shaped cross section and has a third connection portion which is engaged with the first slot or the second slot, the second teeth of each operation member extend transversely, the third connection portion of each operation member has third connection holes, multiple first connection members extend through the first connection holes or the second connection holes and are connected to the third connection holes to connect the operation members to the first connection portion and the second connection portion.

4. The monkey wrench as claimed in claim 1, wherein the first resilient member has a loop which is located corresponding to the second pivotal portion, a first biasing portion and a second biasing portion located on two ends of the first resilient member, the first biasing portion biases the first teeth, the second biasing portion hooks to the press member and biases the press member so as to engage the third teeth with the first teeth, the first rivet extends through the first pivotal portion, the second pivotal portion and the loop.

5. The monkey wrench as claimed in claim 1, wherein the first control unit comprises two clips, the control rod has a groove defined in each of two ends thereof, the two ends of the control rod are exposed out from the body, there are two control members which are connected to the two ends of the control rod and contact the outside of each of the two sidewalls of the body, the two control members are located symmetrically relative to the body and each are a rectangular member, each of the control members has a fourth hole through which one of the two ends of the control rod extends, the two clips are engaged with the two grooves of the two ends of the control rod to connect the control members to the control rod.

6. The monkey wrench as claimed in claim 1, wherein the first rod is snugly engaged with the second circular hole, the second rod is snugly engaged with the first circular hole.

7. The monkey wrench as claimed in claim 1, wherein the first connection portion is integrally formed with the operation member, the second connection portion is integrally formed with the operation member.

8. The monkey wrench as claimed in claim 1, wherein the first jaw is integrally formed with the body, the fixing member is connected to the first holes, the second jaw located in the first recess and is restricted by the fixing member.

* * * * *